US007163314B2

(12) United States Patent
Sharrah

(10) Patent No.: US 7,163,314 B2
(45) Date of Patent: Jan. 16, 2007

(54) FLASHLIGHT HAVING AN ADJUSTABLE GRIP

(75) Inventor: Raymond L. Sharrah, Collegeville, PA (US)

(73) Assignee: Streamlight, Inc., Eagleville, PA (US)

( * ) Notice: Subject to any disclaimer, the term of this patent is extended or adjusted under 35 U.S.C. 154(b) by 201 days.

(21) Appl. No.: 10/742,351

(22) Filed: Dec. 19, 2003

(65) Prior Publication Data

US 2004/0136185 A1 Jul. 15, 2004

Related U.S. Application Data

(60) Provisional application No. 60/438,262, filed on Jan. 6, 2003.

(51) Int. Cl.
*F21L 4/04* (2006.01)

(52) U.S. Cl. ..... 362/206; 362/389

(58) Field of Classification Search ..... 362/382, 362/389, 396, 399, 400, 457, 118, 183–208
See application file for complete search history.

(56) References Cited

U.S. PATENT DOCUMENTS

| | | | | |
|---|---|---|---|---|
| 1,487,983 | A | 3/1924 | Stiriss | |
| 1,696,266 | A | 12/1928 | Coote | |
| 1,769,241 | A | 7/1930 | Stephani | |
| 1,919,024 | A | 7/1933 | Abbotts | |
| 2,408,601 | A | 10/1946 | Blauvelt | |
| 2,937,266 | A * | 5/1960 | Munro | 362/191 |
| 3,590,235 | A | 6/1971 | Leo et al. | |
| 3,631,236 | A * | 12/1971 | Woytowich | 362/197 |
| 4,327,401 | A | 4/1982 | Siiberg | |
| 4,581,686 | A | 4/1986 | Nelson | |
| 4,609,976 | A | 9/1986 | Geissler | |
| 4,620,534 | A | 11/1986 | Zartman | |
| 4,704,663 | A | 11/1987 | Ohashi | |
| 4,737,894 | A | 4/1988 | Kuch et al. | |
| 4,841,417 | A | 6/1989 | Maglica et al. | |
| 5,345,370 | A | 9/1994 | Murray et al. | |
| 5,406,735 | A | 4/1995 | Howell | |
| 5,422,798 | A | 6/1995 | Osiecki et al. | |
| 5,446,633 | A | 8/1995 | Hanggi | |
| 5,586,976 | A | 12/1996 | Coutoumanos | |
| 5,642,932 | A | 7/1997 | Matthews | |
| 5,690,416 | A * | 11/1997 | Van Gennep | 362/191 |
| 5,743,623 | A | 4/1998 | Kerr | |
| 5,848,834 | A | 12/1998 | Kerr | |
| 6,099,138 | A * | 8/2000 | Cardan | 362/109 |
| 6,270,231 | B1 | 8/2001 | Kerr | |

(Continued)

OTHER PUBLICATIONS

Mag Instrument, Inc., "The Maglite Family," www.maglite.com, 2001, 2002, 9 Pages.

(Continued)

*Primary Examiner*—Sandra O'Shea
*Assistant Examiner*—Jason Moon Han
(74) *Attorney, Agent, or Firm*—Dann, Dorfman, Herrell and Skillman; Clement A. Berard

(57) ABSTRACT

A flashlight comprises a flashlight body and an annular ring slideably fitting on the flashlight body, and means for fixing the annular ring at a desired position on the flashlight body. The means may include a set screw. An optional and/or removable clip may be disposed longitudinally on the flashlight body between the flashlight body and the annular ring.

23 Claims, 2 Drawing Sheets

U.S. PATENT DOCUMENTS 6,612,714 B1 * 9/2003 Morre et al. ..... 362/191

OTHER PUBLICATIONS

Streamlight, Inc., "Stinger XT HP Information," www.streamlight.com, Printed 2003, 1 Page.
Streamlight, Inc., "Stinger Series Specifications," www.streamlight.com, Printed 2003, 3 Pages.
Streamlight, Inc., "Key-mate Information," Printed 2003, 2 Pages.
Streamlight Inc., SL Series Specifications, www.streamlight.com, Printed 2003, 2 Pages.
Plow & Hearth Products for Country Living, "Triad Flashlight," www.plowhearth.com, 2003, 2 Pages.
Union Carbide Corp., "Eveready Lighting Products," 1983, 18 Pages.

* cited by examiner

FLASHLIGHT HAVING AN ADJUSTABLE GRIP

This Application hereby claims the benefit of the priority of U.S. Provisional Patent Application No. 60/438,262 filed Jan. 6, 2003.

The present invention relates to a flashlight, and, in particular, to a flashlight having an adjustable grip.

Flashlights sometimes have arrangements of gripping regions and switches that make it awkward for a user to activate the switch while holding the flashlight in a manner desirable for a particular task. Slide switches, typically mounted along the body or housing of the flashlight, may be awkward, and so switches are often located on the tail end of the flashlight, i.e. the end opposite the end at which light is produced, often referred to as the rear end or tail. Light is produced at the front end or head thereof. While a pushbutton switch at the tail helps, the user's fingers may slip along the body or housing of the flashlight.

One approach to providing a convenient grip includes a circumferential raised grip element on the body against which two or more fingers may rest for holding a flashlight while pressing the thumb against the rear end or tail thereof, i.e. the end opposite the front end or head thereof at which light is produced. Prior art flashlights, however, have grip elements that are either fixed in one location or are movable by the insertion of spacer elements only to a limited number of fixed locations. Such flashlights have the disadvantage that the predetermined fixed positions of the grip ring do not fit the grip of every user due to the differences in the sizes of the user's hands. In addition, the prior art flashlights are also disadvantageous because they need separate spacer elements to adjust the grip position. An example of such prior art light is shown in U.S. Pat. No. 5,642,932 entitled "Combat-Oriented Flashlight."

Further, prior art lights are incompatible with a pocket clip and so may need a holster or other attachment to hold the flashlight in a user's pocket and the like.

Accordingly, there is a need for a flashlight having an adjustable grip. It would be desirable to have a flashlight also having a clip or an optional clip.

To this end, the present invention comprises a flashlight having a body and an annular ring slideably fitting on the body thereof, and means for fixing the annular ring at a desired position on the body thereof.

According to another aspect of the invention, an annular grip ring comprises an annular ring having a central opening for receiving an article body therein, wherein the annular ring has a central opening for slideably surrounding the article body when the article body is therein. The annular ring including means for fixing the annular ring at a desired position on the article body.

BRIEF DESCRIPTION OF THE DRAWING

The detailed description of the preferred embodiments of the present invention will be more easily and better understood when read in conjunction with the FIGURES of the Drawing which include.

Figure 1:
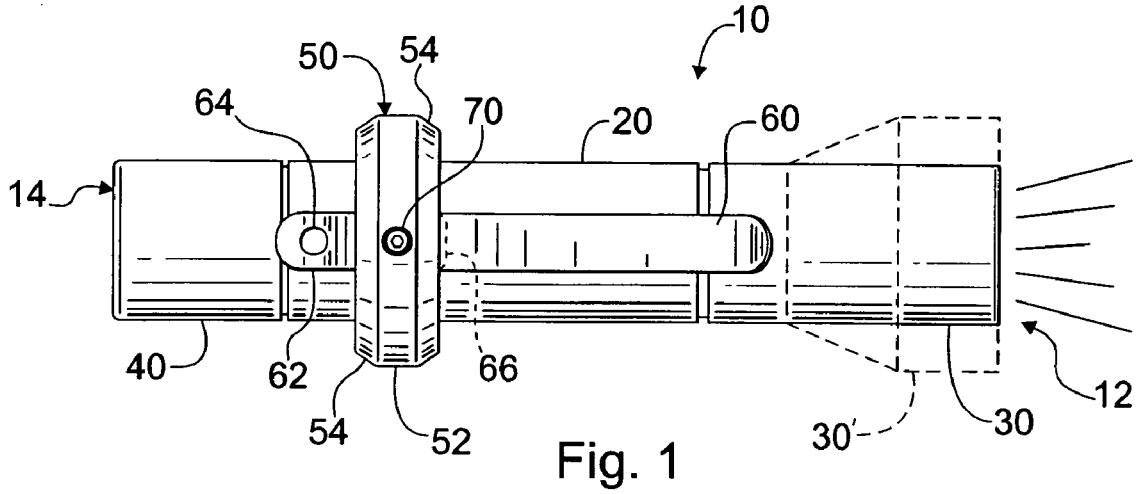
FIGS. 1 and 2 are respective side views of an example embodiment of a flashlight having an adjustable annular grip.

In the Drawing, where an element or feature is shown in more than one drawing figure, the same alphanumeric designation may be used to designate such element or feature in each figure, and where a closely related or modified element is shown in a figure, the same alphanumerical designation primed or designated "a" or "b" or the like may be used to designate the modified element or feature. Similarly, similar elements or features may be designated by like alphanumeric designations in different figures of the Drawing and with similar nomenclature in the specification. It is noted that, according to common practice, the various features of the drawing are not to scale, and the dimensions of the various features are arbitrarily expanded or reduced for clarity.

DESCRIPTION OF THE PREFERRED EMBODIMENT

Figure 2:
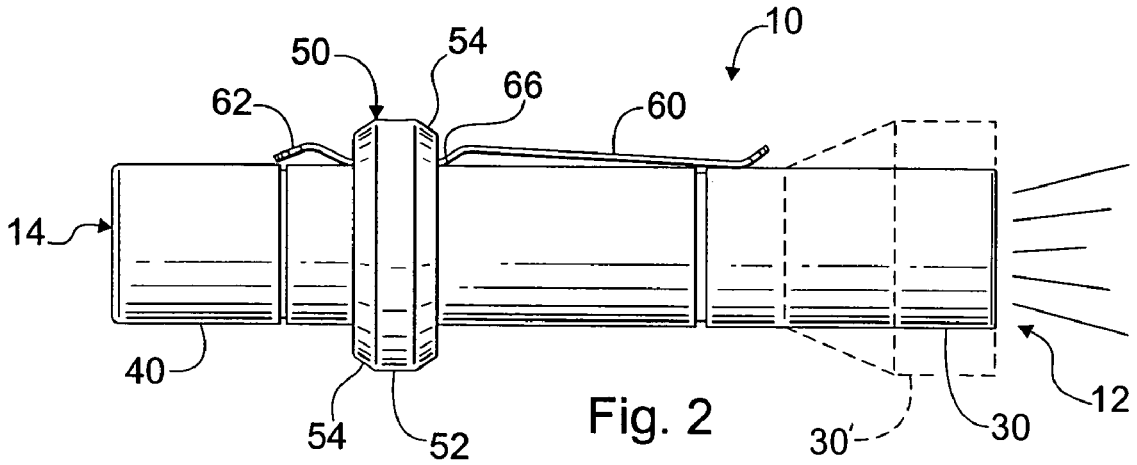

FIGS. 1 and 2 are respective side views of an example embodiment of a flashlight 10 having an adjustable annular grip 50. Flashlight 10 has a head or forward end 12 at which a beam of light is produced and has a tail or rearward end 14 opposite head 12. Flashlight 10 has a body 20 (sometimes referred to as a barrel or housing 20), e.g., for holding one or more batteries, a head assembly 30, e.g., for holding a light source, and a tail cap 40, e.g., for providing a switch. Grip ring 50 is an annular member having an opening therethrough in which the body 20 of flashlight 10 is disposed. Grip ring 50 surrounds body 20 and is slidable longitudinally along body 20 to a desired position on flashlight 10. Typically, the diameter of the central opening of grip ring 50 is slightly larger than the outer diameter of body 20, e.g., as in a slip fit.

Optional removable clip 60 is disposed longitudinally adjacent body 20 extending towards head 30 and is disposed through the opening through grip ring 50 for being fixed with respect to body 20. Set screw 70 is tightened for fixing grip ring 50 in a desired position along flashlight 10, as well as for fixing optional clip 60 with respect to body 20. Clip 60 preferably extends through grip ring 50 towards the tail cap 40 of flashlight 10 and extending part 62 has an opening 64 therein, e.g., for receiving a lanyard, a key ring or other ring, and/or other attaching device.

Body 20, as well as head 30 and tail cap 40, are preferably cylindrical and threadingly engage each other, however, they may have another cross-sectional shape. It is desired that the cross-sectional shape of at least body 10 be of substantially uniform transverse dimension over its length so that grip ring 50 may slide along body 10 with a consistent fit. Grip ring 50 is, for example, cylindrical having a cylindrical outer circumference 52 and optionally has beveled edges 54, however, grip ring may be rounded or have any other desired shape, both circumferentially and/or in cross-section.

Also illustrated in FIGS. 1 and 2 is an alternative embodiment wherein head 30' (illustrated by dashed lines) is of larger diameter than that of body 20 and tail cap 40, as may be desirable where a different reflector arrangement is desired or where a more powerful lamp is employed. In addition, clip 60 need not extend the full length as illustrated to provide a pocket or belt clip, but may be shorter, e.g., ending at dashed line 66 so as to provide only a lanyard clip having a part 62 with an opening 64 therein, e.g., for receiving a lanyard, a key ring or other ring, and/or other attaching device.

Figure 3:
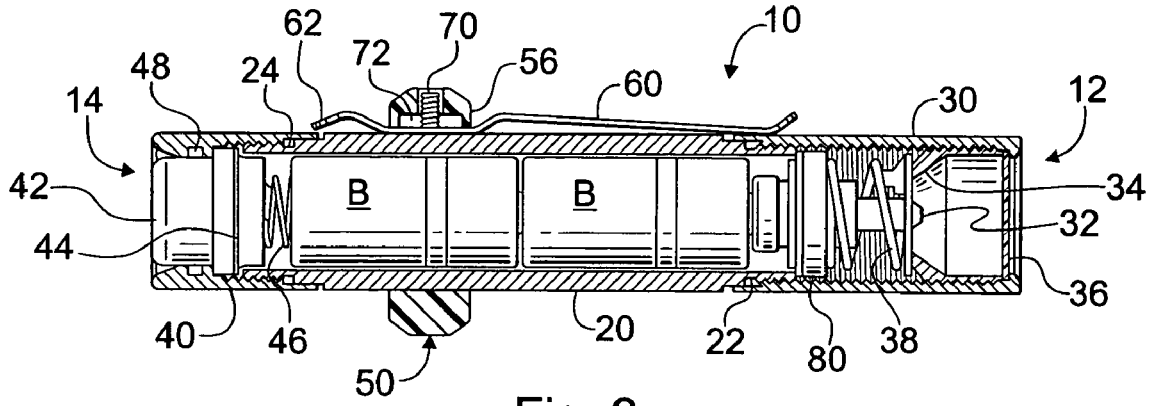
FIG. 3 is a side cross-sectional view and FIG. 4 is a transverse cross-sectional view of the example embodiment of the flashlight of FIGS. 1 and 2.
Figure 4:
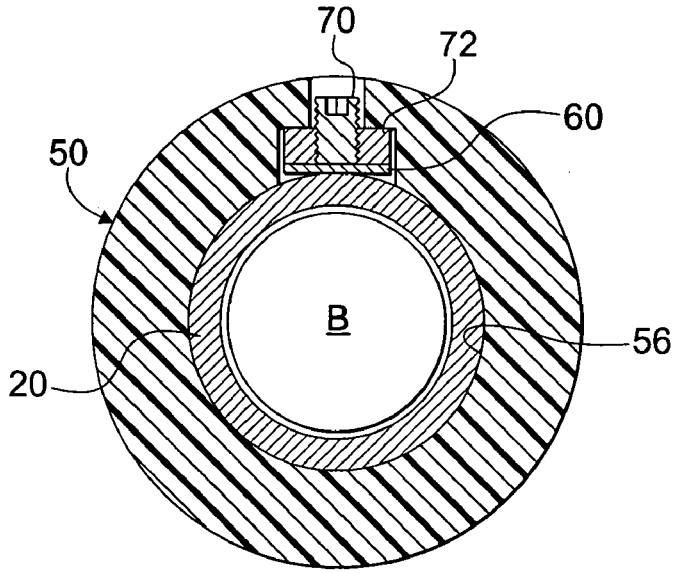

FIG. 3 is a side cross-sectional view and FIG. 4 is a transverse cross-sectional view of the example embodiment of the flashlight 10 of FIGS. 1 and 2. Body 10 is, for example, a hollow cylindrical member having an internal cavity for receiving one or more batteries B. Body 10 is, for example, threaded at both ends for engaging like threads of head 30 and of tail cap 40, respectively.

Head 30 is, for example, a hollow cylindrical member for holding therein a light source 32 proximate a reflector 34 for projecting light through lens 36 when light source 32 is energized. Head 30 is threaded for engaging one threaded end of body 20. Reflector 34 is threaded to thread into head 30 and to trap and seal lens 36 against a forward rim of head 30, whereby reflector 34 is in fixed position with respect to head 30. Light source 32 mounts to light holder 80, e.g., light source 32 is a bi-pin bulb that plugs into two electrical contacts in the insulating polymer body of light holder 80, and light holder 80 is urged rearward by spring 38 to bear against the forward edge of body 20 to make electrical contact thereto. Thus rotating head 30 relative to body 20 causes head 30 and reflector 34 therein to move forward or rearward together with respect to body 20 while the position of light source 32 with respect to body 20 does not change, thereby to adjust the focusing as a result of changing the relative positions of light source 32 and reflector 34. A similar arrangement may be employed where a larger diameter head 30' is provided.

Tail cap 40 is, for example, a hollow cylinder for holding therein a switch for selectively making electrical connection between the rear end for battery B and the end of body 20. Spring 46 urges pushbutton 42 and contact 44 rearward in tail cap 40 while providing electrical connection between contact 44 and battery B.

Light source 32 is energized by electrical energy from batteries B as follows. One or more batteries B are connected in series and the forward end thereof connects to one pin or electrical lead of light source 32 via light holder 80. The other pin or electrical lead of light source 32 connects via light holder 80 to body 20. Body 20 is preferably of conductive material, e.g., aluminum or another metal, and/or conductive plastic. Head 30 need not be electrically conductive where light holder 80 makes electrical contact to body 20 and tail cap 40 need not be electrically conductive. If electrical connection were desired to be made via head 30 and/or tail cap 40, then a conductive material should be utilized therefor.

Pushbutton 42 and electrical contact 44 are movable axially within tail cap 40 for providing a switch for selectively completing a circuit for energizing light source 32. To this end, the rear end of batteries B connects via conductive spring 46 to contact 44 and contact 44 and pushbutton 42 are urged by spring 46 rearward so that contact 44 does not contact housing 20. When contact 44 is moved forward, e.g., by pressing on pushbutton 42 and/or by turning tail cap 40 with respect to body 20 so that it advances toward the head end of flashlight 10, contact 44 moves forward until it touches and makes electrical contact to the rearward end of conductive body 20, thereby completing the circuit for energizing light source 32.

A preferred switch arrangement energizes light source 32 momentarily when pushbutton 42 is pressed and energizes light source 32 continuously when tail cap 40 is rotated to be screwed down onto body 20. Suitable switch arrangements are described, for example, in U.S. Pat. No. 6,491,409 entitled "Flashlight Pushbutton Switch" and in U.S. patent application Ser. No. 10/238,747 entitled "Flashlight Pushbutton Switch" filed Sep. 9, 2002, both of which are hereby incorporated herein by reference in their entirety.

Grip ring 50 is illustrated in cross-section in FIGS. 3 and 4 on body 20, with optional removable clip 60 disposed in the central opening of grip ring 50 between grip ring 50 and body 20. Grip ring 50 has an axial key way 56 therein proximate the central opening thereof. Key way 56 is sized for receiving a nut 72 therein, e.g., the width of key way 56 is about the same as the distance between opposing flats of nut 72. Set screw 70 is disposed in a radial hole through grip ring 50 that joins to key way 56 so that the threads of set screw 70 engage the threads of nut 72 for fixing grip ring 50, and optional clip 60, in a desired position along flashlight 10 when set screw 70 is tightened.

Grip ring 50 is preferably formed of a relatively non-elastic material that will tend to hold its shape sufficiently when set screw 70 is tightened for fixing the position of grip ring 50 on body 20 that the frictional bearing of grip ring 50, set screw 70 and/or clip 60 against body 20 will tend to hold grip ring 50 in a desired position on body 20. Relatively rubbery or stretchable elastomers, such as silicone and rubber, are not desirable materials for grip ring 50, and relatively non-elastic materials, such as nylon, polycarbonate, polystyrene, GE Delran® plastic, ABS plastic, wood, metal, and the like, may be utilized for grip ring 50.

Key way 56 is a recess sized for receiving a nut 72 or a threaded insert 72 therein. The threads of screw 70 engage the threads of nut or threaded insert 72 for fixing grip ring 50, and optional clip 60, in a desired position on flashlight 10 when screw 70 is tightened.

An advantage obtains because grip ring 50 may be fixed at any desired position along flashlight 10. To reposition grip ring 50, set screw 70 is loosened, grip ring 50 is slid to the desired location, and set screw 70 is tightened. Thus grip ring 50 may be fixed any position rather than in a limited number of positions defined by one or more spacers. In addition, the need for extra parts such as spacers is eliminated. It is noted that set screw 70 bears against clip 60 and not body 10, thereby reducing marring.

In addition, the described arrangement permits a substantial clip 60 to be provided for directly holding flashlight 10 in a pocket or on a belt and the like, wherein the clip extends toward head 30 so that when the user grasps flashlight 10 with his fingers, it is in a position wherein it may be activated conveniently. In other words, the user may directly grasp flashlight 10 with two fingers touching grip ring 50 and his thumb against pushbutton 42 whereby flashlight 10 is ready for use as removed from a pocket, belt or the like. Also desirably, clip 60 is removable and/or replaceable by loosening set screw 70, slipping clip 60 out from under grip ring 50 or placing clip 60 under grip ring 50, and tightening set screw 70. Also desirably, clip 60 may be a lanyard clip including part 62 with hole 64 therethrough and ending at line 66, as illustrated in FIGS. 1 and 2.

As illustrated, the cross-sectional shape of grip ring 50 has five sides defined by cylindrical surface 52, two bevels 54, the two ends thereof and the central opening 56 thereof. It is noted that the cross-sectional shape of grip ring 50 may be circular, semi-circular, a partial oval or ellipse, rectangular or any desired shape.

In an example embodiment of flashlight 10, body 20, had 30 and tail cap 46 are machined from series 6000 aluminum and have an anodized finish. Grip ring 50 is a GE Delrin® Delrin® polymer material, but could be another plastic or metal. Light source 32 is a high pressure Xenon-filled bi-pin incandescent lamp that provides rated nominal Illumination of about 100 lumens, 4000 candlepower, that is energized by two 3-volt lithium batteries. Lens 36 is of a high-temperature glass. Light holder 80 has a body of relatively non-elastic electrically insulating polymer material, such as GE Delrin® plastic, but could be nylon, polycarbonate, polystyrene, ABS plastic, or other electrically insulating material. Optional clip 60 is of spring steel. electrically insulating polymer material, such as GE Delran® plastic, but could be nylon, polycarbonate, polystyrene, ABS plastic, or other electrically insulating material. Optional clip 60 is of spring steel.

One example embodiment of a flashlight 10 is about 12.2 cm (about 4.8 inches) long and about 2.2 cm (about 0.88 inches) in diameter, and includes a grip ring 50 that has an outer diameter of about 3.5 cm (about 1.38 inches), an inner diameter of slightly more than about 2.2 cm (about 0.88 inches) so as to be adjustable to any position along body/barrel 20, and an axial length of about 1.25 cm (about 0.5 inch).

However, the diameters of body or barrel 20, head 30 and tail cap 40 need not be the same. In another example embodiment of a flashlight 10, body/barrel 20 is about 12.2 cm (about 4.8 inches) long and about 2.2 cm (about 0.88 inches) in diameter, head 30' is about 4 cm (about 1.6 inches) long and about 3.2 cm (about 1.25 inches) in diameter, and tail cap 40 is about 2.3 cm (about 0.9 inches) long and about 2.2 cm (about 0.88 inches) in diameter. Grip ring 50 has an outer diameter of about 3.5 cm (about 1.38 inches), an inner diameter of slightly more than about 2.2 cm (about 0.88 inches) so as to be adjustable to any position along body/barrel 20, and an axial length of about 1.25 cm (about 0.5 inch).

A flashlight 10 comprises a flashlight body 20, 30, 40 including a light source 32, a source B of electrical energy and a switch 42, 44, 46 for selectively connecting the light source 32 and the energy source B in circuit for energizing the light source 32. An annular grip ring 50 defines a central opening 56 for receiving the flashlight body 20, 30, 40 therein, wherein the annular grip ring 50 slideably surrounds the flashlight body 20, 30, 40. A screw 70 is disposed in a hole of the annular grip ring 50 for fixing the annular grip ring 50 in a desired position on the flashlight body 20, 30, 40. The flashlight 10 further comprises an optional clip 60 of which a part is disposed through the central opening 56 of the annular grip ring 50 adjacent the flashlight body 20, 30, 40 and is fixed thereagainst by the set screw 70. The clip 60 includes a portion 60 for clipping to a pocket and/or has a hole 64 adapted for receiving a lanyard.

The flashlight body 20, 30, 40 has a certain cross-sectional shape and the annular grip ring 50 has a central opening 56 of the certain cross-sectional shape, which may be circular, oval, elliptical, rectangular, pentagonal, hexagonal or octagonal. The screw 70 threadingly engages one or more of the hole in the annular grip ring 50, a nut 72 disposed in a recess in the annular grip ring 50 and/or a threaded insert 72 disposed in the annular grip ring 50. Flashlight body 20, 30, 40 includes a body portion 20, a head 30 and a tail cap 40, wherein the body portion 20 and at least part of the head 30 and/or tail cap 40 are of like cross-sectional shape and size. The annular grip ring 50 is slideable on the body portion 20 and on the at least part of the head 30 and/or tail cap 40 of like cross-sectional shape and size. The flashlight annular ring 50 includes means 70, 72 for fixing the annular ring 50 at a desired position on flashlight body 20, 30, 40 and may include one or more of a screw 70, a set screw 70, a threaded insert 72, a nut 72, and a bolt 72, disposed in a hole 56 and/or recess 56 in said annular grip ring.

While the present invention has been described in terms of the foregoing exemplary embodiments, variations within the scope and spirit of the present invention as defined by the claims following will be apparent to those skilled in the art. For example, grip ring 50 could be of any non elastic plastic or metal, and/or light source may be of any desired incandescent or solid state or light-emitting diode light source. Body 20, head 30, 30' and/or tail cap 40, may have a smooth external surface or a textured surface, e.g., a surface that is partly or totally knurled and/or grooved and/or ribbed and/or ridged, as desired. Where the external surface is textured, e.g., knurled, grooved and/or ribbed and/or ridged, it may be desirable to machine, grind or otherwise smooth the surface after the texturing is made to remove any ridges or other projections that may result from the texturing operation, thereby to maintain a more nearly uniform transverse dimension (e.g., diameter in the case of a cylindrical flashlight) so that grip ring 50 is smoothly slidable thereon.

Also, means other than set screw 70 and nut 72 may be provided for fixing the position of grip ring 50 on body 20. For example, grip ring 50 may have a threaded radial hole and/or a threaded insert into which set screw 70 threads, rather than having nut 72 in key way 56. A screw, such as a cap screw, thumb screw or other screw may be utilized. Alternatively, grip ring 50 may be a split ring, e.g., a ring having a radial gap, wherein the gap is closed, or is at least narrowed, by a tangential tightening arrangement, e.g., a screw or nut and bolt, crossing through the gap, thereby to reduce the circumference of the central opening of ring 50 for clamping grip ring 50 to body 20, including fixing the position of clip 60, if utilized.

Where the head 30 and/or the tail cap 40 are in whole or in part of similar diameter to body 20, adjustable grip 50 is slideable along body 20 and at least the similar diameter portions of head 30 and tail cap 40, and may be fixed at any position along body 20 and at least the similar diameter portions of head 30 and tail cap 40. Desirably, the major portion of body 20 is of uniform cross-section, e.g., diameter, to provide a range of positions at which grip 50 may be fixed. The term "body" in the claims is intended to include body 20 and any portions of head 30 and tail cap 40 on which adjustable grip 50 is slideable, unless the context indicates otherwise, e.g., where a head and/or a tail cap is also recited.

While the example embodiments of body 20, head 30 and tail cap 40 are illustrated as being of circular cross-section, as may be typical, they may be of any desired cross-section, e.g., rectangular, pentagonal, hexagonal, octagonal, oval, elliptical, and so forth. FIGS. 1, 2 and 3 can be deemed to illustrate several of such shapes, e.g., at least circular, rectangular, oval and elliptical shapes. In such case, slideably adjustable grip 50 has a central opening 56 therethrough of corresponding cross-sectional shape to the cross-section of body 20, head 30 and/or tail cap 40, so as to be slideable thereon and fixable at a desired position thereon.

Further, clip 60 may take other forms in addition to the typical pocket clip and lanyard clip forms illustrated, and/or, in addition, may be arranged to project in the opposite direction to that illustrated, e.g., toward rearward end 14 rather than toward head end 12.

Further, light 10 may include one or more o-rings for providing seals. E.g, o-ring 48 may be provided surrounding pushbutton 42 to seal against tail cap 40, o-ring 24 may be provided to seal the threads engaging body 20 and tail cap 40 and/or o-ring 22 may be provided to seal the threads engaging body 20 and head 30, thereby providing seals for resisting the intrusion of water and other undesirable matter into the interior of flashlight 10. In addition, an o-ring or other sealing material may be provided between lens 36 and the rim at the forward end of head 30.

What is claimed is:

1. A flashlight comprising a flashlight body a head end having a switch at a tail end of said flashlight body, and an annular grip ring slideably fitting on said flashlight body and defining a key way, wherein said annular grip ring is of sufficiently larger diameter than said flashlight body so as to provide an axial grip for a finger, said annular grip ring including means for fixing said annular grip ring at a desired position on said flashlight body for actuating the tail end switch and gripping said annular grip ring with one hand and for fixing a clip in the key way between said annular grip ring and said flashlight body.

2. The flashlight of claim 1 wherein said flashlight body has a certain cross-sectional shape and wherein said annular grip ring defines a central opening of the certain cross-sectional shape.

3. The flashlight of claim 2 wherein the certain cross-sectional shape is circular, oval, elliptical, rectangular, pentagonal, hexagonal or octagonal.

4. The flashlight of claim 1 wherein said means for fixing includes one or more of a screw, a set screw, a threaded insert, a nut, and a bolt, disposed in a hole and/or recess in said annular grip ring.

5. The flashlight of claim 1 wherein said flashlight body includes a body portion, a head and a tail cap, wherein said body portion and at least part of said head and/or said tail cap are of like cross-sectional shape and size, wherein said annular grip ring is slideable on said body portion and on the at least part of said head and/or said tail cap of like cross-sectional shape and size.

6. The flashlight of claim 1 further comprising a clip of which apart is positioned between said flashlight body and said annular grip ring, wherein said means for fixing holds said clip therebetween.

7. The flashlight of claim 6 wherein said clip includes a portion adapted for clipping to a pocket and/or has a hole adapted for receiving a lanyard.

8. A flashlight comprising:

a flashlight body including a light source near a head end a source of electrical energy, and a switch at a tail end of said flashlight body for selectively connecting the light source and the source of electrical energy in circuit for energizing the light source;

an annular grip ring defining a central opening for receiving the flashlight body therein, wherein said annular grip ring slideably surrounds said flashlight body and is of sufficiently larger diameter than said flashlight body so as to provide an axial grip for a finger;

wherein the central opening of said annular grip ring defines a key way for receiving a clip between said annular grip ring and said flashlight body; and a screw disposed in a hole of said annular grip ring for fixing the annular grip ring in a desired position on said flashlight body for actuating the tail end switch and gripping said grip ring with one hand and for fixing a clip in the key way between said annular arm ring and said flashlight body.

9. The flashlight of claim 8 further comprising a clip of which a part is disposed through the central opening of said annular grip ring adjacent said flashlight body and is fixed thereagainst by said screw.

10. The flashlight of claim 9 wherein said clip includes a portion adapted for clipping to a pocket and/or has a hole adapted for receiving a lanyard.

11. The flashlight of claim 8 wherein said flashlight body has a certain cross-sectional shape and wherein the central opening of said annular grip ring has the certain cross-sectional shape.

12. The flashlight of claim 11 wherein the certain cross-sectional shape is circular, oval, elliptical, rectangular, pentagonal, hexagonal or octagonal.

13. The flashlight of claim 8 wherein said screw threadingly engages one or more of the hole in said annular grip ring, a nut disposed in a recess in said annular grip ring, and/or a threaded insert disposed in said annular grip ring.

14. The flashlight of claim 8 wherein said flashlight body includes a body portion, a head and a tail cap, wherein said body portion and at least part of said head and/or said tail cap are of like cross-sectional shape and size, wherein said annular grip ring is slideable on said body portion and on the at least part of said head and/or said tail cap of like cross-sectional shape and size.

15. A flashlight and grip ring comprising:

a flashlight body having a body portion having a source of electrical energy therein, a head including a light source, and a tail cap including a switch for selectively connecting the light source and the source of electrical energy in circuit for energizing the light source;

an annular grip ring defining a central opening of like shape to a cross-sectional shape of the body portion of said flashlight body for receiving at least the body portion of said flashlight body therein and defining a key way, whereby said annular grip ring slideably surrounds the body portion of said flashlight body and is of sufficiently larger diameter than the body portion of said flashlight body so as to provide an axial grip for a finger; and a set screw disposed in a radial hole of said annular grip ring for fixing the annular grip ring in a desired position on said flashlight body for actuating the tail cap switch and gripping said annular grip ring with one hand, and for fixing a clip in the key way of the central opening between said annular grip ring and said flashlight body.

16. The flashlight of claim 15 wherein said set screw threadingly engages one or more of the radial hole in said annular grip ring, a nut disposed in a recess in said annular grip ring, and/or a threaded insert disposed in said annular grip ring.

17. The flashlight of claim 15 further comprising a clip disposed through the central opening of said annular grip ring adjacent the body portion of said flashlight body and fixed thereagainst by said set screw.

18. The flashlight of claim 17 wherein said clip includes an elongated portion extending along the body portion of said flashlight body for clipping to a pocket and/or has a hole therethrough adapted for receiving a lanyard.

19. The flashlight of claim 15 wherein the central opening of said annular grip ring and the cross-sectional shape of the body portion of said flashlight body are circular, oval, elliptical, rectangular, pentagonal, hexagonal or octagonal.

20. A flashlight and grip ring comprising:

a flashlight body having a body portion for receiving a source of electrical energy therein, a head including a light source proximate a first end of the body portion, and a tail cap including a pushable switch proximate a second end of the body portion for selectively connecting the light source in circuit with a source of electrical energy for energizing the light source;

an annular grip ring defining a central opening for receiving at least the body portion of said flashlight body therein and defining a key way, wherein said annular grip ring slideably surrounds the body portion of said flashlight body and is of sufficiently larger outer diameter than the body portion of said flashlight body so as to provide an axial grip for a finger;

an elongated clip disposed longitudinally along the body portion of said flashlight body in the key way between said annular grip ring and said flashlight body; and a screw threadingly engaging said annular grip ring and bearing against said elongated clip for fixing both said annular grip ring and said elongated clip in a desired position on the body portion of said flashlight body, whereby the flashlight maybe held and operated by one hand touching the annular grip ring and the pushable switch.

21. The flashlight and grip ring of claim 20 wherein in said elongated clip is a pocket clip, or wherein said elongated clip has a hole for receiving a lanyard, or wherein said elongated clip is a pocket clip and has a hole for receiving a lanyard.

22. The flashlight and grip ring of claim 20 wherein said screw includes a set screw disposed in a radial hole in said annular grip ring and threadingly engaging one or more of the radial hole, a nut disposed in a recess in said annular grip ring, and a threaded insert disposed in the radial hole in said annular grip ring.

23. The flashlight and grip ring of claim 20 wherein the body portion of said flashlight body and the central opening of said annular grip ring are both circular, oval, elliptical, rectangular, pentagonal, hexagonal or octagonal.

* * * * *